US007125373B1

(12) United States Patent
Garza

(10) Patent No.: US 7,125,373 B1
(45) Date of Patent: Oct. 24, 2006

(54) CALF BLASTER

(76) Inventor: Ray Garza, 22527 Guardsman La., Katy, TX (US) 77449

( * ) Notice: Subject to any disclaimer, the term of this patent is extended or adjusted under 35 U.S.C. 154(b) by 0 days.

(21) Appl. No.: 10/893,691

(22) Filed: Jul. 19, 2004

(51) Int. Cl.
*A63B 71/00* (2006.01)

(52) U.S. Cl. ..... 482/148; 482/907

(58) Field of Classification Search ..... 482/148, 482/91, 907, 38, 79, 141, 44, 62, 100, 142; D21/665; 59/592.6; 52/591.1–591.3; 446/124–125, 446/127
See application file for complete search history.

(56) References Cited

U.S. PATENT DOCUMENTS 3,485,493 A * 12/1969 Pitkanen ..... 482/34
3,580,865 A * 5/1971 Stone ..... 252/299.7
4,105,201 A * 8/1978 L'Ecuyer et al. ..... 482/34
4,319,748 A * 3/1982 Alter ..... 482/148
4,429,868 A * 2/1984 LeBlanc et al. ..... 482/131
5,147,266 A * 9/1992 Ricard ..... 482/131
5,389,054 A * 2/1995 Dorman ..... 482/34
5,507,711 A * 4/1996 Richardson ..... 482/112
5,616,102 A * 4/1997 Lahmann ..... 482/34
5,762,590 A 6/1998 St. Fleur et al.
5,980,433 A 11/1999 Ramsay
6,171,219 B1 1/2001 Simonson
6,254,517 B1 * 7/2001 Kennedy ..... 482/121
6,436,017 B1 * 8/2002 Chen ..... 482/121
6,461,215 B1 * 10/2002 Kunz et al. ..... 446/107
6,648,805 B1 * 11/2003 Millis ..... 482/148
2004/0154256 A1 * 8/2004 Kim ..... 52/592.6

* cited by examiner

*Primary Examiner*—Lori Amerson

(57) ABSTRACT

A portable lower leg exercise device for facilitates proper body alignment and execution of calf strengthening exercises includes a pivoted pair of elongate members having coplanar upper surfaces to provide a step of sufficient height to support the forefoot of a user through a full range of motion exercising the calf muscle. Guide members insert into the elongate members to define foot spaces that are properly spaced and oriented to promote proper foot alignment throughout the exercises.

9 Claims, 4 Drawing Sheets

CALF BLASTER

I. BACKGROUND OF THE INVENTION

The present invention relates to exercise devices and more particularly pertains to a new portable lower leg exercise device for facilitates proper body alignment and execution of calf strengthening exercises.

II. DESCRIPTION OF THE PRIOR ART

The use of exercise devices is known in the prior art. U.S. Pat. No. 5,762,590 issued to St. Fleur et al. on Jun. 9, 1998 describes a large base for supporting the full body weight of a user lying face down on an angled support panel adjacent to an inclined track that guides weights lifted by extension and contraction of the user's calf muscles. Another type of exercise device is U.S. Pat. No. 5,980,433 issued to Ramsay on Nov. 9, 1999 disclosing a calf exerciser using a pivoting forefoot plate. U.S. Pat. No. 6,171,219 issued to Simonson on Jan. 9, 2001 discloses a large stationary device for exercising calf muscles while the user is seated on the device.

While these devices fulfill their respective, particular objectives and requirements, the need remains for a device that is more compact, portable, and promotes proper foot alignment during use.

III. SUMMARY OF THE INVENTION

The present invention generally comprises a pivoted pair of elongate members having coplanar upper surfaces to provide a step of sufficient height to support the forefoot of a user through a full range of motion exercising the calf muscle. Guide members insert into the elongate members to define foot spaces that are properly spaced and oriented to promote proper foot alignment throughout the exercises.

There has thus been outlined, rather broadly, the more important features of an exercise device in order that the detailed description thereof that follows may be better understood, and in order that the present contribution to the art may be better appreciated. There are additional features of the exercise device that will be described hereinafter and which will form the subject matter of the claims appended hereto.

In this respect, before explaining at least one embodiment of the exercise device in detail, it is to be understood that the exercise device is not limited in its application to the details of construction and to the arrangements of the components set forth in the following description or illustrated in the drawings. The exercise device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present exercise device. It is important, therefore, that the claims be regarded as including such equivalent constructions insofar as they do not depart from the spirit and scope of the present invention.

It is another object of the present invention to provide an exercise device which has all of the advantages of the prior art and none of the disadvantages.

It is another object of the present invention to provide an exercise device which may be easily and efficiently manufactured and marketed.

It is another object of the present invention to provide an exercise device which is of durable and reliable construction.

It is yet another object of the present invention to provide an exercise device which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
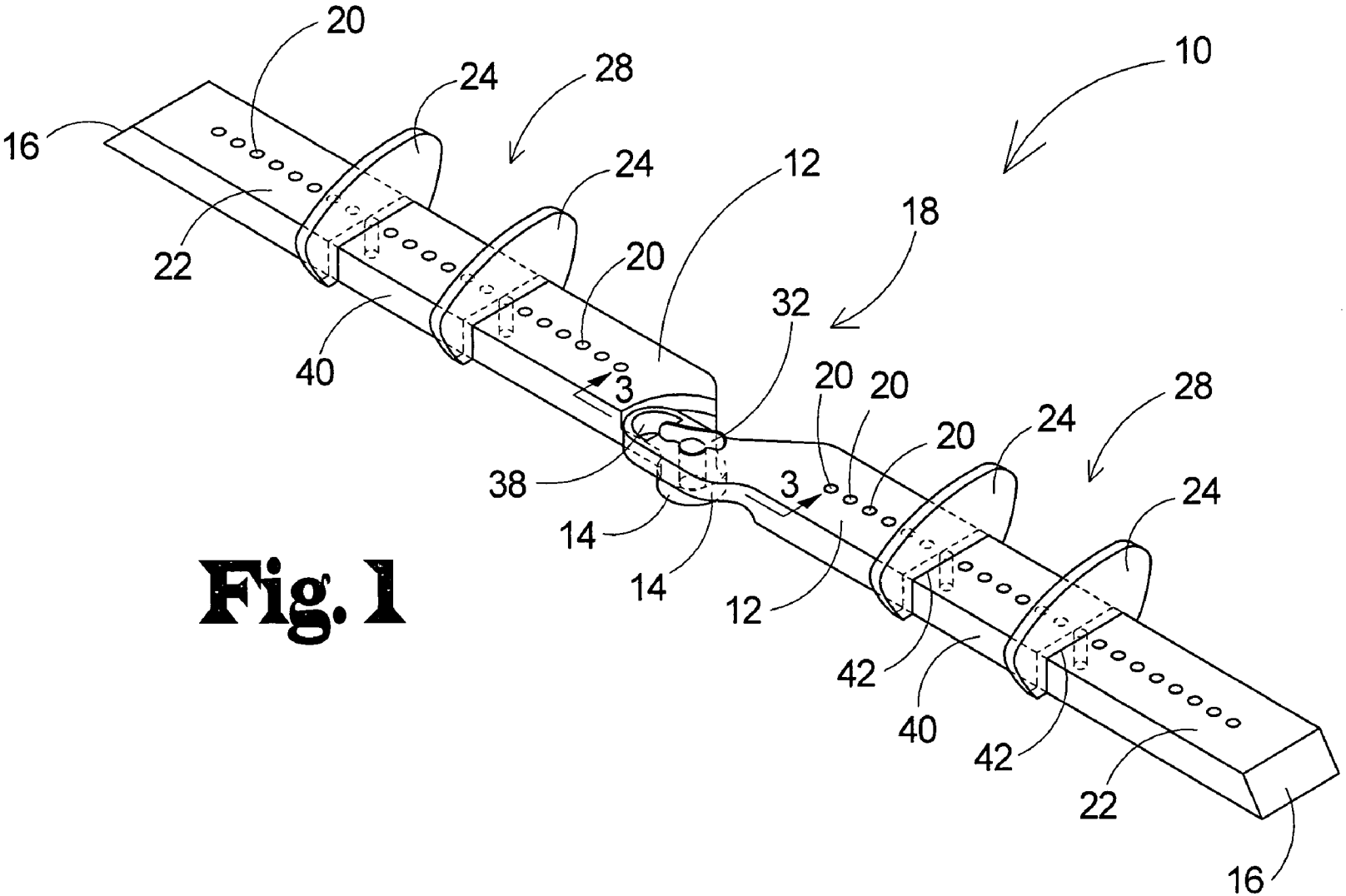
FIG. 1 is a perspective view of a new portable lower leg exercise device according to the present invention.
Figure 2:
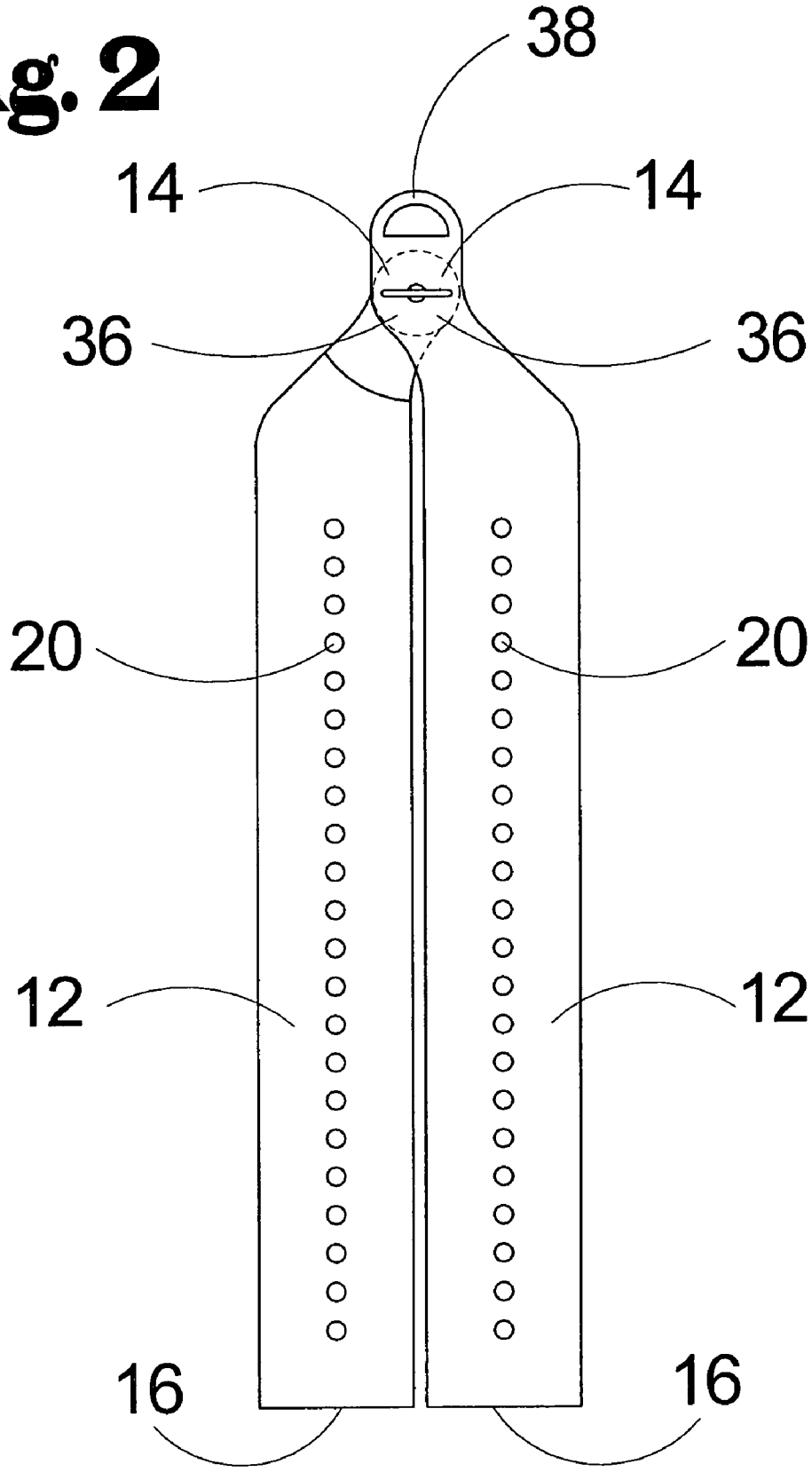
FIG. 2 is a top view of the present invention in a folded position.
Figure 3:
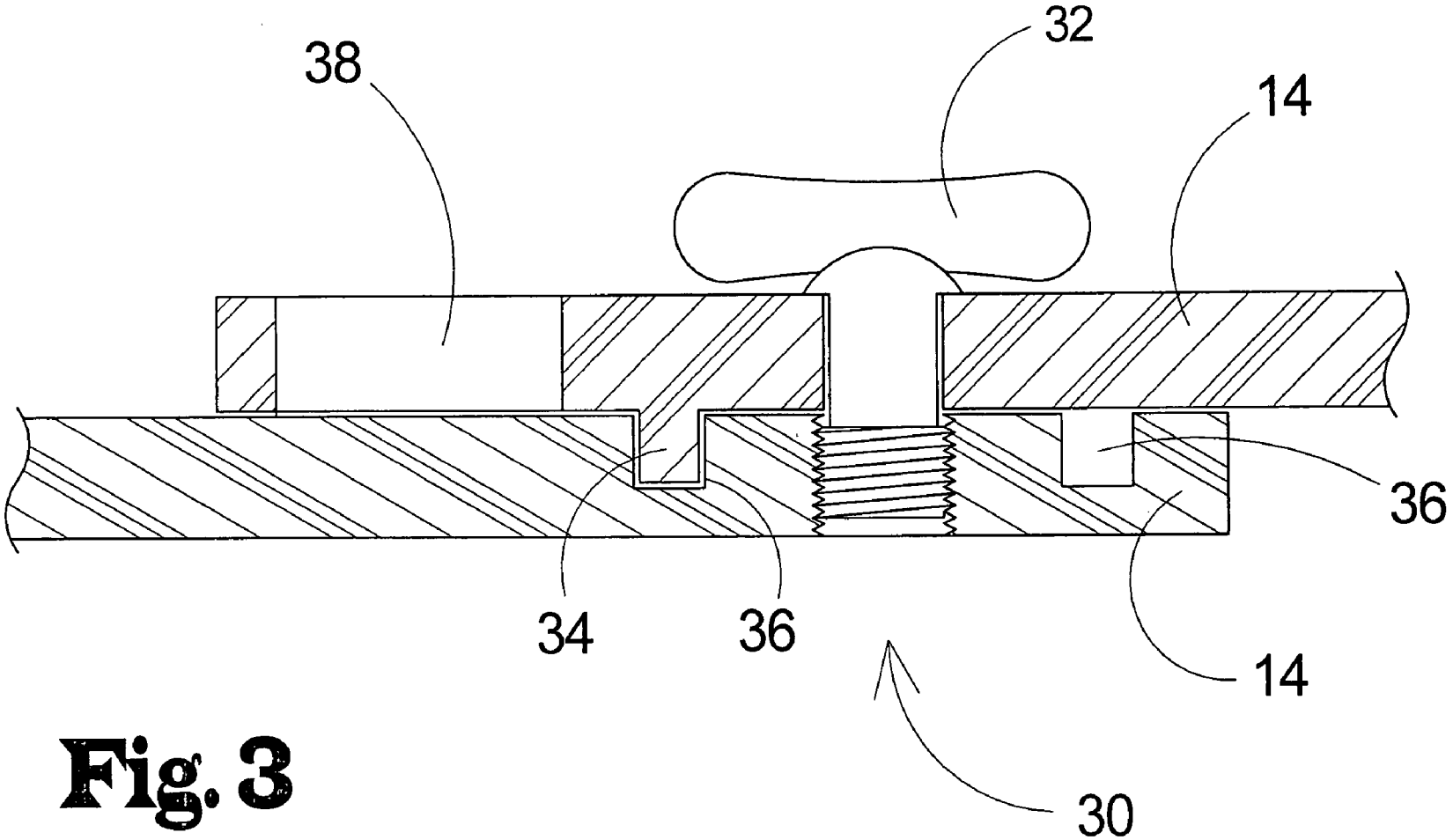
FIG. 3 is a cross-sectional view of the pivotal connection of the elongated members of the present invention.
Figure 4:
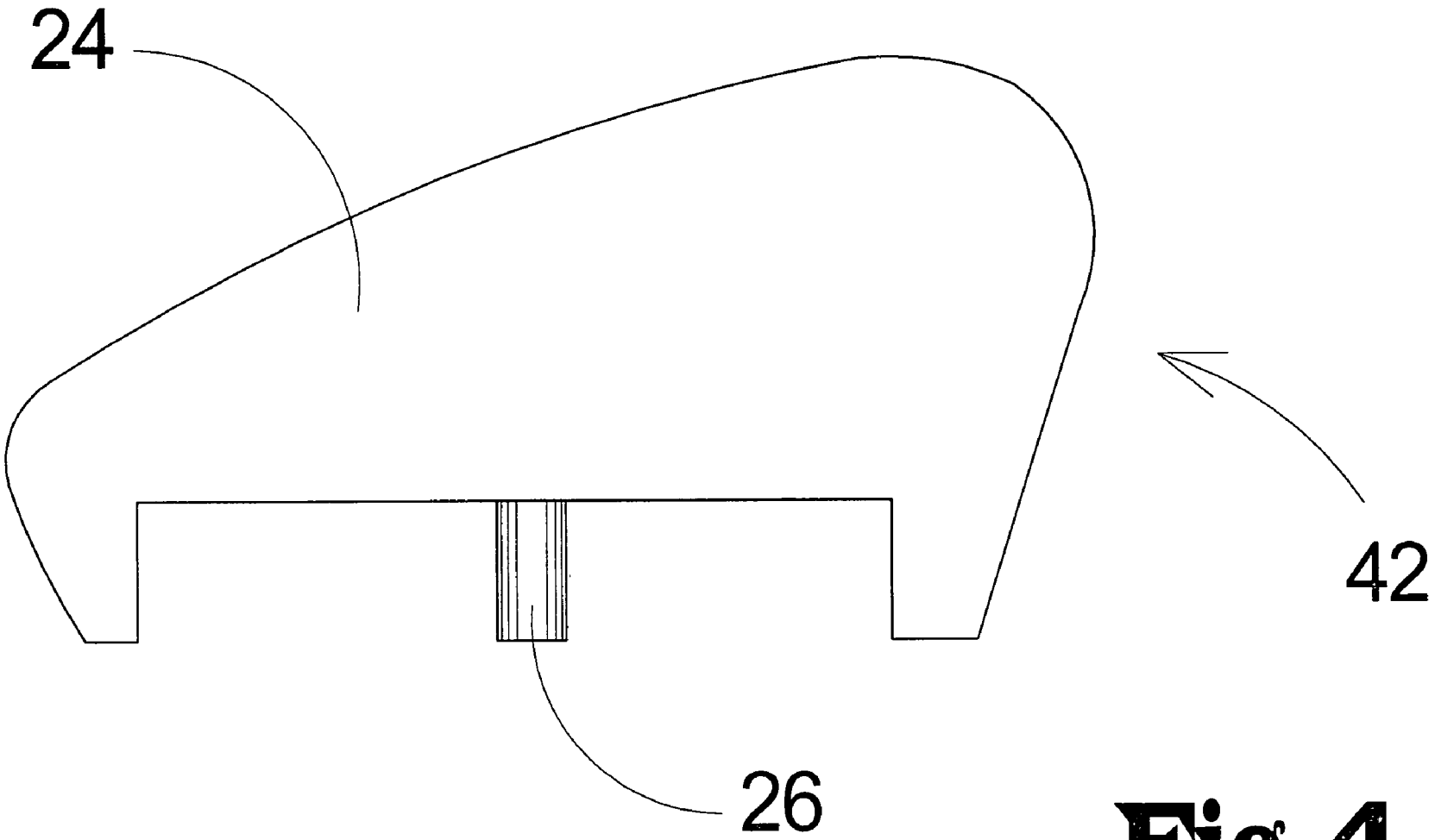
FIG. 4 is a side view of a guide member of the present invention.

With reference now to the drawings, and in particular to FIGS. 1 through 4 thereof, a new portable lower leg exercise device embodying the principles and concepts of the present invention and generally designated by the reference numeral 10 will be described.

As best illustrated in FIGS. 1 through 4, the portable lower leg exercise device 10 to facilitate strengthening of a calf muscle by a user generally comprises a pair of elongated members 12.

Each elongated member 12 has a connection end 14 and a free end 16. The connection ends 14 are pivotally coupled together. A fixing means 18 is coupled to the elongated members 12 for selectively holding the elongated members 12 in a fixed position relative to each other. A plurality of holes 20 extend in spaced relationship along an upper surface 22 of each elongated member 12.

A plurality of guide members 24 each have a post portion 26 insertable into a selectable one of the plurality of holes 20 such that pairs of the guide members 24 are positionable in spaced relationship on the elongated members 12 to form foot receiving spaces 28. Thus, the feet, particularly the forefoot portion, of a user are held in a desired orientation by the guide members 24 during use. The free ends 16 are slanted to assist in stretching of the calf muscles.

The fixing means 18 is preferably formed by a pair of aligned apertures 30 in the elongated members 12 and a screw member 32 insertable into the aligned apertures 30 and engaging the elongated members 12 to frictionally hold the elongated members 12 in the fixed position. Typically, the screw member will pass through one of the elongated members which will be compressed between a head portion of the screw member and the other elongated member as the screw member is tightened. The head portion of the screw member may be designed to have gripping portions to facilitate hand tightening. In an embodiment, the fixing means 18 further includes complimentary structure to facilitate holding the elongated members in a relatively static position. In one specific embodiment, at least one pin member 34 extends from one of the elongated members 12 in spaced relationship to the aligned apertures 30. The fixing means 18 then includes a plurality of receivers 36 spaced radially around the aligned apertures 30 for receiving the pin member 34 to facilitate holding the elongated members 12 in the fixed position and at a selectable angle. The selectable angles possible include a straight orientation of 180 degrees and an acute angle of 45 degrees to point the toes of the user inward or outward during use depending on whether the angle faces towards or away from the user.

The handle portion 38 extends from the connection end 14 of the one of the elongated members 12. The handle portion 38 protrudes outwardly from the elongated members 12 when the elongated members 12 are in a folded position.

Main portions 40 of the elongated members 12 have equal respective thicknesses and upper surfaces 22 of the elongated members 12 are coplanar. The connection ends are offset to permit folding the elongated members 12 into a compact side by side unit wherein the longitudinal axes of the elongated members are substantially parallel.

Each guide member 24 includes a recessed portion 42 complimentary in shape to a cross section of the elongated members 12 for receiving the elongated members 12 when the post portion 26 is inserted into one of the plurality of holes 20. The shape of the guide members serves to hold the feet of the user in the proper position throughout the full range of motion of the foot during exercise.

A storage bag may also be provided and the handle portion typically forms a loop suitable for grasping or hanging the device on a hook or other support.

In use, the elongated members are unfolded to the desired orientation and fixed in place. The guide members are positioned on the elongated members and the user places the forefoot of each foot on the elongated members in the spaces formed by the guide members. The user then raises and lowers him or herself through a full range of motion on the elongated members to exercise the calf muscles. The orientation of the elongated members is changed between sets of exercise to guide the user's feet into toe outward and toe inward orientations.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise device to facilitate strengthening of a calf muscle by a user, said exercise device comprising:

a first elongated member and a second elongated member, each elongated member having a connection end and a free end, said connection ends being pivotally coupled together, the connection end of the first elongated member directly contacting the connection end of the second elongated member, a securement mechanism coupled to said elongated members for selectively holding said elongated members in a plurality of fixed positions relative to each other, a plurality of holes extending in spaced relationship along an upper surface of each elongated member, and a plurality of guide members, each guide member having a post portion insertable into a selectable one of said plurality of holes such that pairs of said guide members are positionable in spaced relationship on said elongate members to form foot receiving spaces whereby feet of a user are held in a desired orientation by said guide members, wherein each guide member includes a recessed portion complimentary in shape to a cross section of said elongated members for receiving said elongated members when said post portion is inserted into one of said plurality of holes.

2. The exercise device of claim 1 wherein said securement mechanism is a pair of aligned apertures in said elongated members and a screw member insertable into said aligned apertures and engaging said elongated members to frictionally hold said elongated members in said fixed position.

3. The exercise device of claim 2 wherein said securement mechanism further includes at least one pin member extending from one of said elongated members in spaced relationship to said aligned apertures, and wherein said securement mechanism further includes a plurality of receivers spaced radially around said aligned apertures for receiving said pin member to facilitate holding said elongated members in said fixed position at a selectable angle.

4. The exercise device of claim 3 wherein said selectable angle is chosen from a group of angles consisting of 45 degrees and 180 degrees.

5. The exercise device of claim 1, further wherein a handle portion extends from one of said elongated members.

6. The exercise device of claim 5 wherein said handle portion extends from said connection end of said one of said elongated members.

7. The exercise device of claim 5 wherein said handle portion protrudes outwardly from said elongated members when said elongated members are in a folded position.

8. The exercise device of claim 1 wherein main portions of said elongated members have equal respective thicknesses and upper surfaces of said elongated members are coplanar.

9. An exercise device to facilitate strengthening of a calf muscle by a user, said exercise device comprising:

a first elongated member and a second elongated member, each elongated member having a connection end and a free end, said connection ends being pivotally coupled together;

a securement mechanism coupled to said elongated members for selectively holding said elongated members in a fixed position relative to each other;

a plurality of holes extending in spaced relationship along an upper surface of each elongated member; and a plurality of guide members, each guide member having a post portion insertable into a selectable one of said plurality of holes such that pairs of said guide members are positionable in spaced relationship on said elongate members to form foot receiving spaces whereby feet of a user are held in a desired orientation by said guide members;

wherein each guide member includes an open sided recessed portion complimentary in shape to a cross section of said elongated members for receiving said elongated members when said post portion is inserted into one of said plurality of holes.

* * * * *